United States Patent [19]

Gray

[11] 4,403,784

[45] Sep. 13, 1983

[54] ROLLER SKATE AXLE SUSPENSION

[76] Inventor: Robert C. Gray, P.O. Box 15262, Tulsa, Okla. 74112

[21] Appl. No.: 227,418

[22] Filed: Jan. 22, 1981

[51] Int. Cl.[3] ..... A63C 17/02

[52] U.S. Cl. ..... 280/11.28

[58] Field of Search ..... 280/11.27, 11.28, 11.26

[56] References Cited

U.S. PATENT DOCUMENTS

| | | | |
|---|---|---|---|
| 311,936 | 2/1885 | Wisewell | 280/11.28 |
| 321,337 | 6/1885 | Becktel . | |
| 321,466 | 7/1885 | Wall | 280/11.28 |
| 1,406,641 | 2/1922 | Hardy | 280/11.26 |
| 2,039,153 | 4/1936 | Edwards | 208/179 |
| 2,122,066 | 6/1938 | Kaptuller | 280/11.26 |
| 2,466,070 | 4/1949 | Balstad | 280/11.28 |
| 2,676,812 | 4/1954 | Owsen et al. | 280/11.28 |
| 2,726,873 | 12/1955 | Woolley | 280/11.28 |
| 3,087,739 | 4/1963 | Ware | 280/11.28 |
| 3,331,612 | 7/1967 | Tietge | 280/11.28 |
| 3,437,344 | 4/1969 | Shevelson | 280/11.2 |
| 3,738,673 | 6/1973 | Iseman | 280/11.28 |
| 3,870,324 | 3/1975 | Balstad | 280/11.28 |
| 3,901,521 | 8/1975 | Famolare, Jr. | 280/11.2 |
| 4,146,241 | 3/1979 | Stevenson | 280/11.27 |

FOREIGN PATENT DOCUMENTS

| | | | |
|---|---|---|---|
| 329221 | 9/1935 | Italy | 280/11.27 |

*Primary Examiner*—Joseph F. Peters, Jr.
*Assistant Examiner*—Kenneth R. Rice
*Attorney, Agent, or Firm*—Head, Johnson & Stevenson

[57] ABSTRACT

A roller skate formed of a plate with an upper surface to receive a shoe and having a forward and rearward downwardly extending suspension housing, each housing having an opening therethrough, an axle extending through each suspension housing opening having means at each end for receiving a skate wheel, a first and second elastomeric member received in each suspension housing in spaced apart relationship, each of the elastomeric members having an opening receiving the axle, bolts extending through threaded openings at the top of the suspension housing, the ends of the bolts engaging the upper surfaces of the elastomeric members so that the compressive force applied by the elastomeric members to the axle may be adjusted by threadably positioning the bolts. Another arrangement includes each axle in two portions hinged in the middle so that each roller skate wheel is independently resiliently supported relative to the skate body.

13 Claims, 7 Drawing Figures

10
12
14
16
18
20
22
24
26
28
30
32
34
34A
34B
36
38
40
40A
40B
42
44A
44B
46
50A
50B
56A
56B
58
60
62A
62B
64
66
68
2

ROLLER SKATE AXLE SUSPENSION

BACKGROUND OF THE INVENTION

1. Field of the Invention

This invention relates to roller skates and more particularly, to means of securing axles which support the roller skate wheels to the skate body in a way to provide improved roller skate performance. Elastomeric members resiliently support the wheel axles to the skate body and include means of varying the force supplied by the resilient members to the axles.

2. Description of the Prior Art

Many different arrangements have been devised for mounting roller skate wheels to a skate body. For improved skating performance, it is desirable that limited movement be provided between the body and the axles of the roller skate wheels. Some designers of roller skates have provided mechanical bearing arrangements for permitting limited movement of the axles relative to the skate bodies and others have provided resilient devices either for supporting the wheel axles to the skate bodies or for limiting the displacement of the axles relative to the bodies.

The invention described herein provides improvements in the prior art by providing, among other features: A roller skate in which the resilient force applied against the deflection of a wheel axle is adjustable; providing independent wheel suspension and movement of each wheel of a roller skate; providing improved means of guiding the path of deflection of a suspended axle relative to the skate body; and providing other arrangements which will be apparent from the following descriptions and claims taken in conjunction with the drawings.

SUMMARY OF THE INVENTION

An improved roller skate is provided by this invention. A skate body having an upper surface adaptable to receive a shoe thereon has a forward and rearwardly downwardly extended suspension housing. Each of the suspension housings has an opening therethrough, the axis of each opening being transverse the vertical plane of the skate body longitudinal axis. An axle is received through the opening in each of the suspension housings. Each of the two axles has means at the outer ends thereof for receiving and retaining skate wheels. A first and second elastomeric member is received in each of the suspension housings, the elastomeric members being spaced apart from each other. Provided in the suspension housings above each of the elastomeric members is a threaded opening. Positioned in the threaded opening is a bolt, the lower end of which engages the upper surface of an elastomeric member. By threadably downwardly positioning the bolts, the amount of resilient force applied by the elastomeric members to the skate axle is adjustable. To prevent the bolts from penetrating the elastomeric members, metal pads are placed above each elastomeric member, the upper surface of each pad being engaged by the end of a bolt. In a preferred embodiment, the opening in each of the suspension housings is elongated in the direction of the suspension housing axis, and washers are positioned on each of the axles, the diameter of the washers being slightly less than the width of the elongated openings so that the washers serve to guide deflection of the axles.

In a further preferred embodiment, each axle is formed of a first and second portion, the portions being hinged at their inner ends to the skate body suspension housing. In this embodiment each of the four wheels of the roller skate are independently deflectable relative to the skate body.

DESCRIPTION OF THE PREFERRED EMBODIMENT

Figures 1, 2, 6:
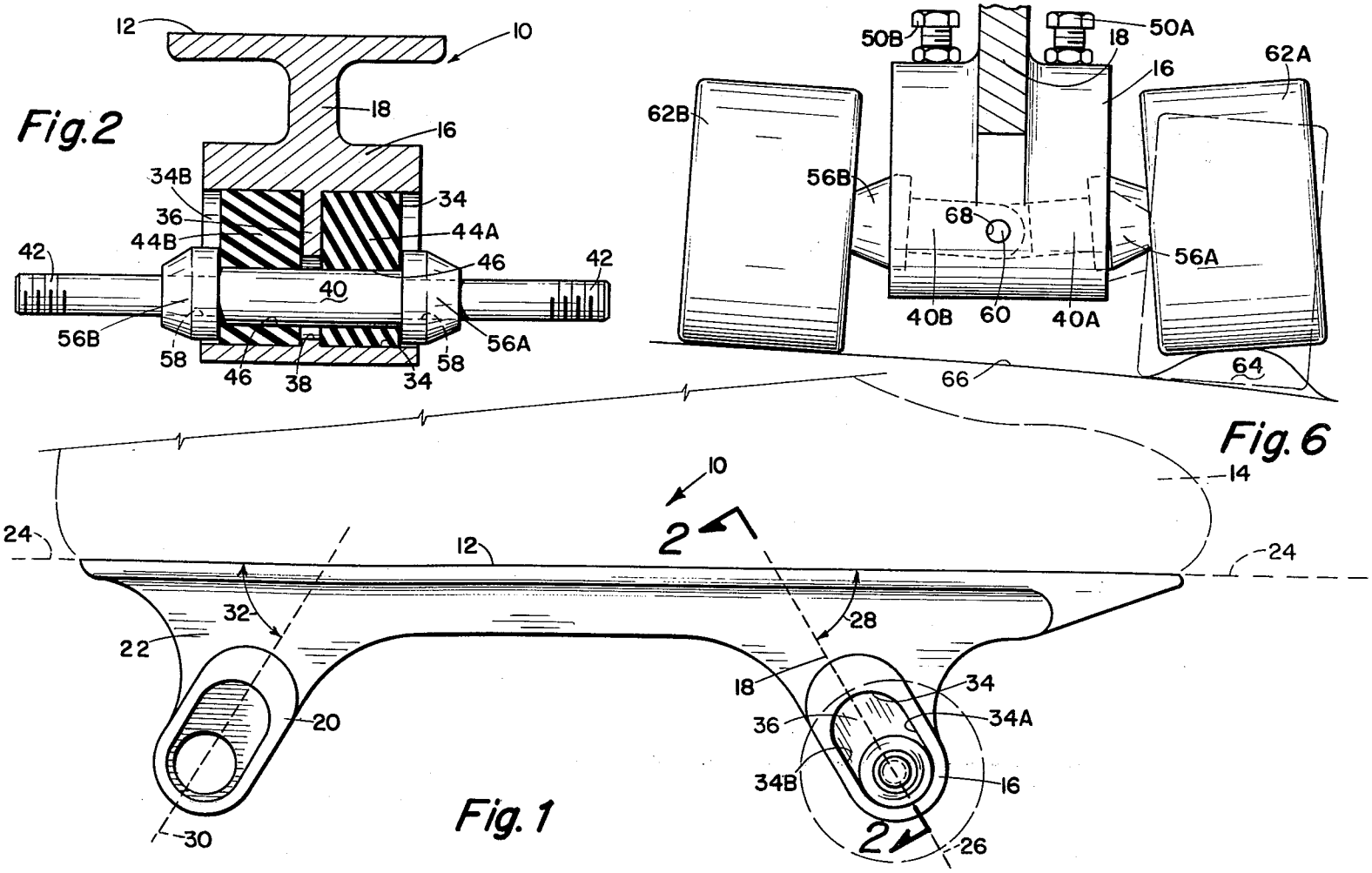
FIG. 1 is a side elevational view of a skate body, a portion of a shoe which is receivable on the upper surface of the skate body being shown in dotted outline.
FIG. 2 is a cross-sectional view taken along the line 2—2 of FIG. 1 and showing the embodiment of the invention employing a solid axle.
FIG. 6 is a front cross-sectional view taken along the line 6—6 of FIG. 3 and showing how the wheels of the roller skate are independently supported when the axle arrangement of FIG. 4 is employed.

Referring now to the drawings and first to FIG. 1, a roller skate body is generally indicated by the numeral 10. The body includes an upper surface 12 adaptable to receive a shoe thereon, indicated in dotted outline by the numeral 14. In some skates detachable means are provided for securing the skate body 10 to a shoe. Since various a means of attaching the body to a shoe are well known in the art, they are not part of this invention.

Integrally formed with body 10 is a forward downwardly extending suspension housing 16. In this illustrated arrangement the suspension housing 16 is formed integrally with the body 10 although it can be seen that it could be a separate element attached such as by bolts, to the body. As shown in the cross-sectional view of FIG. 2, the forward suspension housing 16 is integrally formed with the body 10 and connects to it by means of a web 18. Also extending downwardly from the body is a rearward suspension housing 20 which connects to the skate body by web 22 in the same manner as the forward suspension housing. The arrangement of the rearward suspension housing 20, its manner of supporting skate wheels and so forth is the same as for the forward suspension housing and therefore, all further description in the invention will be made with reference to the forward suspension housing 16.

The roller skate body 10 has a longitudinal axis indicated by the dotted line 24. The forward suspension housing 16 has an axis of suspension indicated by the dotted line 26. The suspension axis 26 intersects the skate longitudinal axis 24 at an angle 28, the angle being preferably between 50° and 60° with 55° being ideal. It can be seen that angle 28 may vary up to 90° and then slant rearwardly, but the preferred arrangement is as illustrated with the angle being about 55° with the axis 26 slanted in the forward direction. The rear suspension housing longitudinal axis 30 intersects the body longitudinal axis 24 by an angle 32 which also preferably is about 55° and angle 32 may vary in the same manner as angle 28.

Extending through the forward suspension housing 16 is an opening 34. Shown in FIGS. 2 and 5, the opening 34 is interrupted at its mid-point directly under the skate body 10 by an integral spacer 36 which has a smaller diameter opening 38 therein. The axis of opening 34 and opening 38 is perpendicular to the suspension axis 26 and is also perpendicular to the vertical plane of the skate longitudinal axis 24.

Received in openings 34 and 38 is a skate axle 40. Each outer end of axle 40 is provided with means to retain a roller skate wheel thereon, such as provisions of threads 42.

Figure 7:
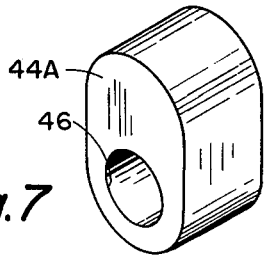
FIG. 7 is an isometric view of an elastomeric member as employed in the invention.

Received within opening 34 are elastomeric members 44A and 44B. A representative configuration of an elastomeric member is depicted in FIG. 7. Each of the elastomeric members has an opening 46 therein which receives the skate axle 40. The function of the elastomeric members is to apply resilient force against the deflection of the axle 40 but permit limited deflection of the axle relative to the suspension housing 16 in response to shifting weight of the skate user.

In the illustrated and preferred arrangement, the opening 34 in housing 16 is elongated with the axis of elongation being the same as the axis of suspension 26. The provision of an elongated opening 34 provides parallel side walls 34A and 34B (see FIG. 1) with the top and bottom of the opening 34 being semi-circular. The shape of the elastomeric members 44A and 44B, as shown in FIG. 7, corresponds to the shape of the opening 34.

Figure 4:
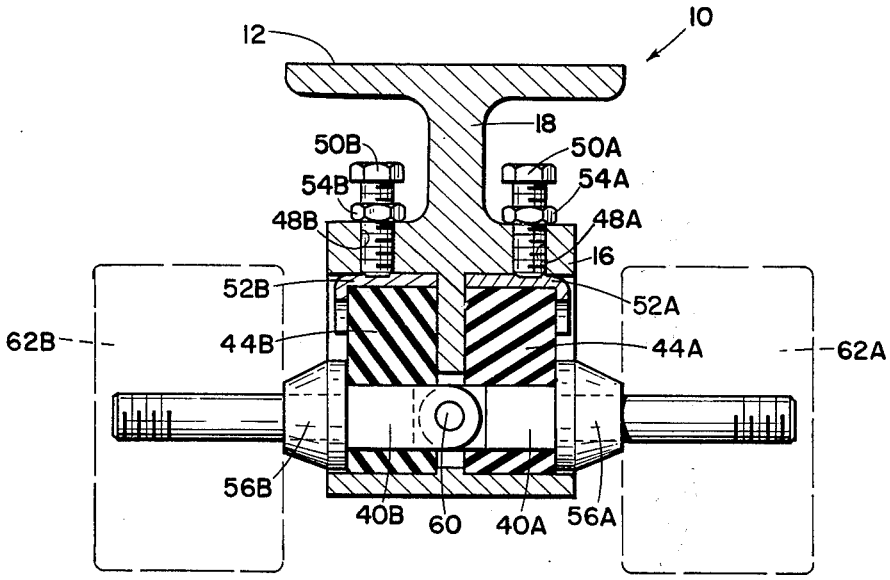
FIG. 4 is a cross-sectional view taken along the line 4—4 of FIG. 3 showing the means of adjusting the compressive force supplied by the elastomeric members to the axle and further, showing the arrangement in which the axle is formed of two portions, hinged in the middle, providing for independent suspension of each wheel of the roller skate.
Figure 3:
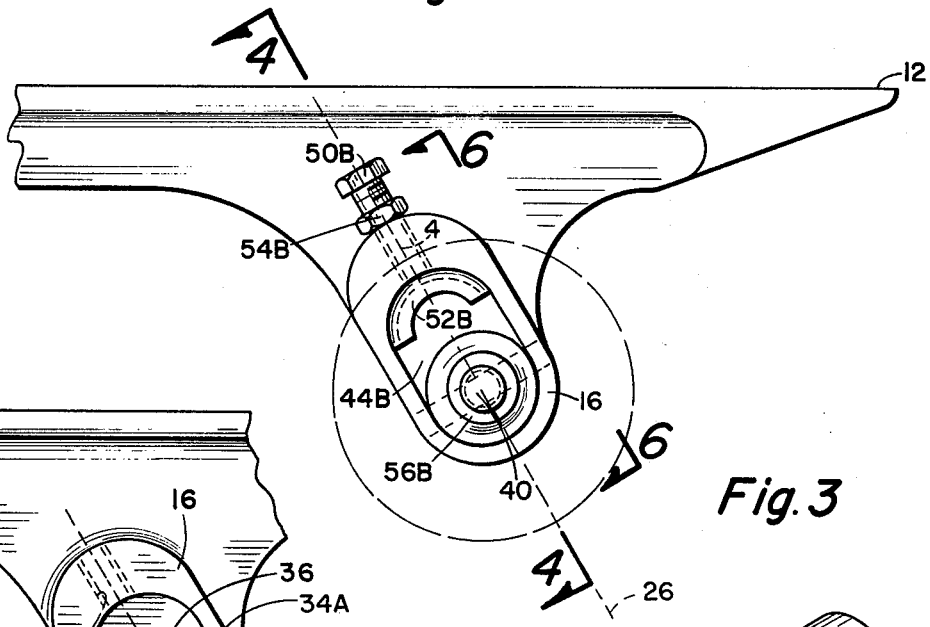
FIG. 3 is an enlarged side elevational view of the skate body showing the forward suspension housing and showing means of independently adjusting the compressive force applied to the axle.

An important aspect of this invention is means of varying the amount of compressive force applied by elastomeric members 44A and 44B to axle 40. This is illustrated best in FIGS. 3 and 4. FIG. 4 shows threaded openings 48A and 48B in the upper end of suspension housing 16, that is, in the direction towards skate body top surface, 12. In the preferred arrangement the axis of threaded openings 48A and 48B are in a common plane with the suspension axis 26. Received within the threaded openings 48A and 48B are bolts 50A and 50B. The lower ends of the bolts serve to engage the elastomeric members 44A and 44B. To prevent the bolts from sinking into the surface of the elastomeric members, pads 52A and 52B are provided. The shape of each of the pads is semi-circular with an outer downwardly extending lip. Pads 52A and 52B are inserted into the suspension housing opening 34 to engage the upper surfaces of the elastomeric members 44A and 44B. In this manner the downward end of bolts 50A and 50B engage the pads and as the bolts are threadably downwardly extended the pads compress the elastomeric members 44A and 44B to apply increased compressive force against the deflection of axle 40. Nuts 54A and 54B are used to retain the bolts 50A and 50B in preselected positions.

Received on axle 40 exteriorly of the elastomeric members 44A and 44B are washers 56A and 56B. Each washer has an opening 58 therein to receive the axle. The outside diameter of each of the washers 56A and 56B is slightly less than the spacing between the opposed side walls 34A and 34B of opening 34. Washers 56A and 56B permit the deflection of each end portion of axle 40 in the direction of the axis of suspension 26 but resist deflection in the direction perpendicular to axis 26.

It can be seen that web 26 which is utilized to provide a separation between elastomeric members 44A and 44B may be replaced by a washer or other separate element which need not be integrally formed with the suspension housing 16.

An important innovation of this invention is the provision of means wherein each of the four wheels of a roller skate may be independently supported and in which the force resisting deflection of each of the wheels may be independently adjustable. FIG. 4 shows the arrangement wherein the axle 40 is formed of two portions 40A and 40B. The axle is hinged together in the middle by hinge pin 60. Rather than being hinged together the axle portions 40A and 40B may be separately independently hinged at their inner ends to the housing 16. By the provision of the axle portions 40A and 40B being hinged at their inner ends, each axle outer end is free to independently deflect by compressing the elastomeric member 44A or 44B. As shown in FIG. 6, roller skate wheels 62A affixed to the outer end of axle portion 40A has engaged a bump 64 on an otherwise smooth skating surface 66. This has caused wheel 62A to deflect upwardly without substantially affecting the orientation of wheel 62B and the axle portion 40B to which it is attached. Washer 56A serves to guide the deflection of axle portion 40A so that it moves in a plane of the suspension axis.

Figure 5:
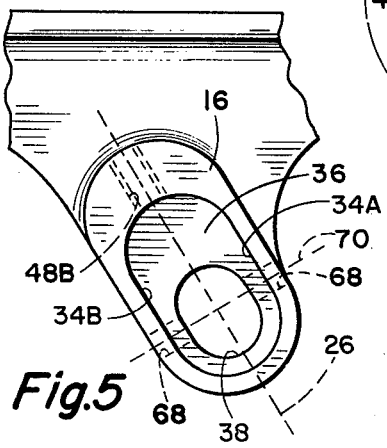
FIG. 5 is an enlarged fragmentary elevational view of a roller skate body showing a preferred configuration of the opening formed in the suspension housing.

Hinge pin 60 preferably is attached to the housing 16. An opening 68 formed in housing 16, as shown in FIGS. 5 and 6, serves to receive the hinge pin 60. The axis 70 of opening 68 is perpendicular to the suspension axis 26. This arrangement retains the two portions 40A and 40B of the axle in proper relationship to the housing while nevertheless allowing independent wheel suspension of the axles.

It can be appreciated that the invention describes a roller skate having improved features including separate resilient deflectable support relative to each roller skate axle and in which the resilient force resisting deflection of the roller skate wheel axle is adjustable. Further, the invention provides a method of mounting roller skate wheels in which each of the four wheels of a roller skate are independently deflectable relative to the others and in which the resistance to such independent deflection is independently adjustable.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. In a roller skate comprising:

a skate body with an upper surface adaptable to receive a shoe thereon, and having forward and rearward downwardly extending suspension housings, at least one housing having an opening therethrough the axis of the opening being transverse the vertical plane of the skate body longitudinal axis;

an axle extending through each said suspension housing opening having an intermediate point and means at each end thereof to receive a skate wheel;

a first and second elastomeric member received in said suspension housing opening in spaced apart relationship, each elastomeric member engaging said axle in an area between the axle intermediate point and the portion receiving a skate wheel; and means of separately adjustably varying the compressive force applied by each said elastomeric member against deflection of said axle in the direction towards said skate body.

2. A roller skate according to claim 1 including:

means between said elastomeric members holding said members spaced from each other.

3. A roller skate according to claim 1 wherein said suspension housing has spaced apart threaded openings therein in the direction towards the skate body and wherein said means of adjustably varying the compressive force applied by said elastomeric members is in the form of threaded members received in said threaded openings, the lower ends of which engage said elastomeric members.

4. A roller skate according to claim 3 including a metal pad received within said opening in said suspension housing above each of said elastomeric members, the lower end of each said threaded member engaging a pad to displace the elastomeric members downwardly against said axle.

5. A roller skate according to claim 1 in which said opening in said suspension housing is elongated in the direction of the longitudinal axis of the downward extension of said suspension housing, the opening having parallel opposed sidewalls in planes parallel the longitudinal extension axis, and including:

a bearing washer received on each end of the axle interiorly of said skate wheels, the outside diameter of the washers being slightly less than the spacing between said opening sidewalls, said washers serving to guide said axle in up and down motion in the plane of the suspension housing longitudinal axis.

6. A roller skate according to claim 1 wherein said axle is formed of two lengths, each having an inner end and an outer end, the outer end of each length having means to receive a roller skate wheel, and the inner ends being hinged to each other.

7. A roller skate according to claim 1 wherein each of said axle lengths is hinged at its inner end to said suspension housing.

8. A roller skate according to claim 1 wherein the longitudinal axis of suspension of at least one of said suspension housings relative to said skate plate upper surface is at an angle between 50° and 60°.

9. A roller skate comprising:

a skate body with an upper surface adaptable to receive a shoe thereon, and having a forward and a rearward downwardly extending suspension means;

an axle for each said suspension means, the axles having means at the outer ends for receiving skate wheels thereon, at least one of the axles being defined by a first and second part, each part having an inner end, and each part having a hinge pin opening adjacent the inner end;

a hinge pin received by said hinge pin opening of each said axle part, the hinge pin being retained in a selected position by said suspension means; and means to resiliently bias each said axle portion in the direction away from said skate body.

10. A roller skate according to claim 9 wherein said skate body has a longitudinal axis and wherein said suspension means has a longitudinal axis extending at a selected angle from said skate body, and wherein said hinge pin is in the vertical plane of said skate body longitudinal axis and perpendicular to said suspension means longitudinal axis.

11. A roller skate according to claim 9 in which said means to resilient bias each said axle portion includes elastomeric means.

12. A roller skate according to claim 11 in which said elastomeric means is in the form of separated, spaced apart elastomeric members received by said suspension means, each elastomeric member having an opening therein receiving a said axle portion.

13. A roller skate according to claim 12 including means of adjustably varying the compressive force applied by said elastomeric members.

* * * * *